US006245196B1

(12) United States Patent
Martin et al.

(10) Patent No.: US 6,245,196 B1
(45) Date of Patent: Jun. 12, 2001

(54) METHOD AND APPARATUS FOR PULP YIELD ENHANCEMENT

(75) Inventors: Pierre Henri Rene Martin, Ville de Lery (CA); Jacobo Kogan, Evanston, IL (US); Ka Kee Ho, Mississauga; Peter Campbell, Toronto, both of (CA)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/241,617

(22) Filed: Feb. 2, 1999

(51) Int. Cl.[7] ..... D21C 9/00

(52) U.S. Cl. ..... 162/11; 162/16; 162/60; 162/62; 162/63; 162/29

(58) Field of Search ..... 162/11, 16, 60, 162/62, 63, 29

(56) References Cited

U.S. PATENT DOCUMENTS

| | | | | |
|---|---|---|---|---|
| 2,828,297 | | 3/1958 | Glesen et al. | 260/124 |
| 3,937,647 | | 2/1976 | Backstrom et al. | 162/16 |
| 4,042,452 | | 8/1977 | Arhippainen et al. | 162/60 |
| 4,269,656 | | 5/1981 | Perkins | 162/30 |
| 5,429,717 | * | 7/1995 | Bokstrom | 162/60 |

OTHER PUBLICATIONS

Hartler, "Sorption Cooking: Yield Increase for Unbleached Alkaline Pulps through Sorption of Organic Substance from the Black Liquor", Svensk Papperstidn (1978).

Parsad et al., "High–kappa Pulping and Extended Oxygen Delignification Decreases Recovery Cycle Load", Tappi, vol. 77, No. 11 (1994).

Ferweda, "Washing Improvement through Brownstock Acidification with Carbon Dioxide", Article (1995).

Jameel et al., "Extending Delignification with AQ/Polysulfide", Tappi, vol. 79, No. 9 (1995).

White, "Carbon Dioxide on Pulp During Washing in the Minimum Impact Mill", Pulp Washing (1996).

* cited by examiner

*Primary Examiner*—Peter Chin
*Assistant Examiner*—Mark Halpern
(74) *Attorney, Agent, or Firm*—Donald T. Black

(57) ABSTRACT

The process of the present invention purposefully precipitates a portion of the dissolved lignin onto pulp fibers to improve pulp yield of unbleached pulp. The resulting retention of lignin on the pulp creates an increase in pulp yield. Washing the pulp in a series of washer stages sequentially removes entrained lignin. Between each of the washer stages, adding dilution water repulps a pulp mat that exits from a prior washer stage and creates a pulp stream for a next washer stage. After at least one of the washer stages, adding an acidifying agent to the pulp stream forms a pulp product by precipitating the entrained lignin onto cellulosic fibers contained in the pulp stream. Finally, the process removes the pulp product from the series of washer stages with the pulp product having at least about a 1 unit increase in Kappa number.

9 Claims, 3 Drawing Sheets

METHOD AND APPARATUS FOR PULP YIELD ENHANCEMENT

FIELD OF THE INVENTION

This invention is related to the reduction of pulp cost and the improvement of pulp yield by the precipitation of lignin on cellulose fibers during production of non-bleached paper products.

BACKGROUND OF THE INVENTION

The Kraft cooking process is a common chemical pulping method for wood and non-wood sources to produce cellulosic fibers. Essentially, the Kraft process involves the chipping of raw woodstock and cooking it in a digester with sodium hydroxide and sodium sulfide (collectively known as white liquor) at a specified temperature and pressure. The resulting reaction product is separated into cellulosic fibers (generally called pulp) and spent cooking chemicals, together with most of the lignin, the organic material that binds the fibers together. During the cooking reaction, lignin is dissolved and becomes part of the liquor, along with the spent cooking chemicals. The spent cooking chemicals and dissolved lignin are collectively known as black liquor.

Kraft cooking can generally be separated into two categories: cooking for bleached products and cooking for unbleached products. The difference in the two categories is the amount of cooking chemicals (white liquor) used, the temperature at which the cook is carried out and the amount of time the chips are exposed to the cooking liquor. Depending on the desired grade of pulp to be produced, the cooking process is operated to achieve pulp of a specific degree of delignification, typically measured as a Kappa number.

The Kappa number test is used to determine the amount of lignin remaining on pulp after cooking. The Kappa number is defined as the number of milliliters of 0.1N potassium permanganate solution consumed by one gram of pulp and corrected for 50% consumption of the potassium permanganate initially added (TAPPI Test Method T236 cm-85; CPPA Standard G.18). Table 1, below, gives typical Kappa number values, % lignin and yield for pulps produced for various paper products.

TABLE 1

| Pulp produced for | Bleached Paper | Unbleached paper | Unbleached board |
|---|---|---|---|
| Kappa Number | 20–35 | 35–120 | 40–120 |
| % Lignin on Pulp | 2.9–5.1 | 5.1–18 | 6–18 |
| Total Yield | 44–46% | 46–50% | 50–58% |
| Screened Yield | 41–44% | 45–56% | 48–56% |

The degree of cook is also indicative of the amount of lignin that is dissolved in the cooking liquor. This can be measured by taking the cooking liquor from a given Kappa cook, acidifying to a low pH (<3) and recovering and measuring the weight of the resulting precipitate.

The Kraft cooking process recycles the spent cooking chemicals through a process known as the recovery cycle. The spent cooking chemicals and dissolved lignin are removed from the pulp product via counter-current washing with water. The washed pulp is recovered as solids and the diluted, spent cooking chemicals and dissolved lignin are recovered as a liquid known as weak black liquor. The weak black liquor is evaporated to high suspended solids concentration and is incinerated in a recovery boiler where some of the heat from burning lignin is recovered as power and steam and the spent cooking chemicals are recovered as a smelt. The spent cooking chemicals are then further processed to convert $Na_2CO_3$ to NaOH together with a small amount of $Na_2S$, collectively known as white liquor.

Raw materials represent a substantial cost of any pulp. Improvements in pulp yield can dramatically affect the economics of the process. Therefore, even small improvements in pulp yield can translate into substantial economic benefits and increased production.

High yields can be achieved by various pulping methods, one of which is mechanical pulping that works by simply grinding the raw material into pulp. The Kraft process, however, has a relatively low yield but produces pulp having high strength. Yield is defined as the amount of pulp, by weight, that is produced from a given amount of raw material, expressed as a percentage of the given amount of raw material. For example, a yield of 70% means that 70 g of pulp are produced from 100 g of raw material.

One reason for the high strength of Kraft pulp is that the cellulose fibers are relatively unharmed by the cooking process—as opposed to being ground into smaller pieces as is done in mechanical pulping. On the other hand, the low yield of the Kraft process results from lignin being extracted from the wood, effectively reducing yield to between 41% and 44%.

Pulps produced for unbleached products are generally higher yield pulps than bleached pulps because less of the lignin is dissolved in the cooking liquor and washed away in the subsequent chemical recovery step. The difference between Total Yield and Screened Yield is the undercooked wood removed in screening (an operation performed to remove undercooked fiber bundles from the pulp stream). Increasing cooking severity increases Screened Yield at the expense of Total Yield.

There are many methods for improving Kraft pulp yield. Generally, yield improvements are achieved by one or more of three methods: process modifications, pulping additives, and method changes.

(a) One method of improving pulp yield involves the addition of additives to the cooking liquor at the digester in an attempt to protect the cellulosic pulp fibers from degradation. Such additives include anthraquinone (AQ) and polysulfide. The yield improvement results because the additives protect the cellulosic fibers from degradation.

(b) Slight modifications to the process can also improve yield. The most common process modification, called "high Kappa pulping", evolved from environmental requirements and the proliferation of oxygen delignification. It involves modifying the cooking conditions, as measured by H-factor, such that the lignin content of the final pulp product is higher than normal. H-factor is determined by plotting the relative reaction rate against the reaction time in hours, and measuring the area under the curve. Parsad demonstrated high Kappa pulping by modifying the H-factor of several Kraft cooks; his results show that as Kappa number increases, yield also increases. (See: Parsad, Brijender; et al. "High Kappa Pulping and Extended Oxygen Delignification Decreases Recovery Cycle Load." Tappi Journal, Vol. 77, No. 11 (November 1994)). This method of yield improvement occurs in the digester area. Furthermore, lignin is not precipitated onto the fibers, as is done by the invention described below. Rather, lignin is never broken down and dissolved in the cooking liquor for removal in washing. In addition, this process is intended to be used with oxygen delignification, which subsequently removes the lignin at a later process step by oxidizing and dissolving the lignin.

This method has the additional disadvantage in producing less Total Yield. If cooking is not carried out to a sufficient extent, all of the chips may not be broken down into individual fibers, leaving some fibers bundled together, known as shives. Shives can adversely affect the final product's appearance and physical properties due to the relatively poor fiber-to-fiber bonds. Shives are removed and recycled to the digester in a cleaning step known as screening, effectively reducing digester capacity.

(c) Another method of improving the yield of a Kraft cook is known as "sorption cooking" and has been investigated by Nils Hartler of the Swedish Forest Products Research Laboratory. (See: Hartler, "Sorption Cooking: Yield Increase for Unbleached Alkaline Pulps Through Sorption of Organic Substance from the Black Liquor." Svensk Papperstidn (October 1978); U.S. Pat. No. 3,937,647. This method involves a lowering of the pH of the black liquor at the end of the cooking process to precipitate lignin onto the fibers. An acid, preferably $CO_2$, is used to lower the pH of the liquor to 8.0 with the result that yield is improved by 1% to 2%. Hartler uses an acid, preferably $H_2SO_4$, to lower the pH to below 11.0 and to as much as 5.6.

This method of yield improvement is similar to the invention to be described below only so far as it involves precipitation of lignin with an acid. The acid is used to reduce the pH of the cooking liquor at the end of a Kraft cook where lignin concentrations are high, whereas the process of the present invention uses an acid to lower the pulp pH of a dilute lignin containing stream during washing.

(d) Although not a method designed to increase yield, in U.S. Pat. No. 5,429,717, Bokstrom addresses the problem of increasing washing efficiency by use of $CO_2$ to lower the pH of the wash water to increase chemical recovery efficiency and to maintain dissolution of lignin. In the Bokstrom process, the pH of the pulp is lowered to between 6.8 and 9.4 during the washing step, resulting in a desorption of bound sodium and a decrease of dissolved lignin and spent cooking chemical carry over to the bleach plant.

Bokstrom alludes to problems that result when pulp pH is lowered too far, but fails to note the important benefits that can be gained by doing so. In fact, Bokstrom avoids certain pH conditions because of undesirable reactions with residual lignin (col. 2, line 14). Bokstrom balances sodium desorption with lignin removal to wash pulp with more efficient use of chemicals.

In a paper by White discussing Bokstrom's technique, White notes that $CO_2$ addition must occur at the end of the wash line to avoid lignin precipitation (p. 54). (See: White, "Carbon Dioxide on Pulp During Washing in the Minimum Impact Mill." Pulp Washing '96, Tappi (October 1996).

In the above-described prior art, the yield improvement solutions require significant changes to existing equipment, e.g., use of additives to protect the cellulose, pulp cooking to retain lignin rather than precipitate and, in sorption cooking, lowering the pH of the black liquor at the end of cooking to precipitate lignin.

It is therefore an object of the invention to improve the pulp yield of unbleached pulp emerging from a Kraft cooking process.

It is a further object of the invention to provide an economic means for increasing pulp yield in unbleached pulp mills, without requiring substantial modifications to mill equipment.

SUMMARY OF THE INVENTION

The process of the present invention purposefully precipitates a portion of the dissolved lignin onto pulp fibers to improve pulp yield of unbleached pulp. The resulting retention of lignin on the pulp creates an increase in pulp yield. Washing the pulp in a series of washer stages sequentially removes entrained lignin. Between each of the washer stages, adding dilution water repulps a pulp mat that exits from a prior washer stage and creates a pulp stream for a next washer stage. The pulp stream contains the entrained lignin. After at least one of the washer stages, adding an acidifying agent to the pulp stream forms a pulp product by precipitating the entrained lignin onto cellulosic fibers contained in the pulp stream. Finally, the process removes the pulp product from the series of washer stages with the pulp product having at least about a 1 unit increase in Kappa number. This increase in Kappa number arises from the acid-induced precipitating of the entrained lignin.

DETAILED DESCRIPTION OF THE PREFERRED EMBODIMENTS

In the case of producing pulp for bleached products, lignin is undesirable due to its darkening characteristics and is intentionally removed from the process prior to bleaching. This invention offers a simple, low cost and controllable way to increase yield of unbleached pulp in a Kraft mill.

Figure 1:
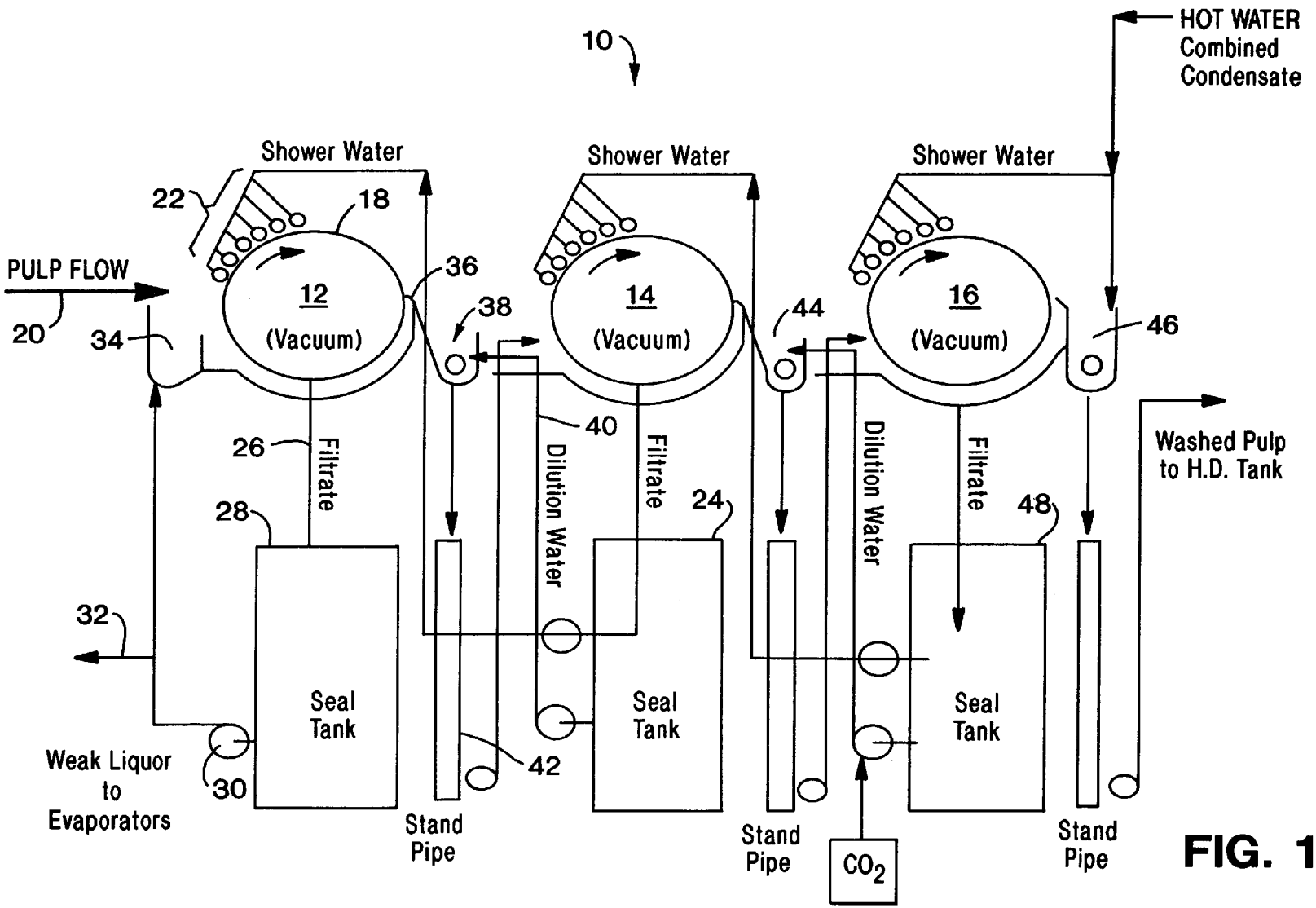
FIG. 1 is a schematic diagram of a pulp washing system for performing the invention.

Referring to FIG. 1, a pulp washer system 10 is shown which incorporates the method of the invention. Pulp washer system 10 includes three washers 12, 14 and 16. Each washer comprises a screened circular drum (e.g. 18) upon which a pulp slurry is placed. A vacuum is applied to the interior of each drum, causing fluids in the pulp slurry to be drawn in through the screen and fed out via a filtrate line (e.g., 26) to a respective seal tank (e.g., 28).

For instance, washer stage 12 includes a screen drum 18 upon which a pulp flow from inlet 20 is placed. Pulp flow 20 comprises a 2–4% solids pulp/water mixture exhibiting a highly basic pH of about 12. A plurality of shower heads 22 feed a seal tank shower stream from an immediately succeeding (e.g., 24) onto the pulp mat that is held up screen drum 18. The shower water that is output by shower heads 22 cause both entrained lignin and sodium compounds to be washed out of the pulp mat and to be fed via filtrate line 26 to seal tank 28.

A recirculating pump 30 removes the black liquor from seal tank 28 and feeds a portion thereof, via piping 32 to an evaporator (not shown), where the sodium chemicals and energy from the combustion of lignin are recovered. A portion of the black liquor is fed back to a mixing region 34 for mixing with the incoming pulp flow 20.

The washer stages sequentially remove entrained lignin from the cellulosic fibers. When the pulp mat is first entrained on screen drum 18, it exhibits a 2–4% solids content. After the pulp mat reaches a scraper 36 however, it exhibits a 20% solids/80% liquid makeup. The pulp mat is scraped off and into a repulper 38 where it receives dilution water via piping 40 from seal tank 24. Within repulper 38, the pulp mat is again liquefied to a 2–4% solids, pulp/water mixture and is then fed to a standpipe 42. The lignin content of the flow into standpipe 42 is advantageously in the range of 0.2 to 5 grams of lignin per liter of liquid. The remainder of the lignin from pulp flow 20 is now contained in seal tank 28.

The above described process is repeated in washers 14 and 16 with the repulped flows from repulpers 44 and 46 exhibiting lignin concentrations of about 0.2 and about 5 grams per liter. This lignin concentration facilitates efficient acid use to achieve effective lignin precipitation. Most advantageously, lignin concentrations range from about 0.5 to about 2 grams per liter. For example, adding carbon dioxide gas to wash water containing 1 to 1.7 grams per liter provides particularly effective lignin precipitation with acid added by means of carbon dioxide gas. In similar fashion, the lignin content in seal tank 24 is considerably less than that found in seal tank 28. Similarly, the lignin content in seal tank 48 is considerably less than that found in seal tank 24.

For multi-stage systems having at least four washing stages it is advantageous to precipitate the entrained lignin in at least two washers. Furthermore, it is most advantageous to precipitate sufficient lignin in each of these washers to increase Kappa number by at least about 1 unit. The use of multiple lignin precipitation provides for an effective increase in pulp yield without a significant drop in pulp properties.

Because of the very high alkalinity and mass of a pulp mat, the pH of filtrate waters fed to the seal tanks range from approximately 10.5 to 12, irrespective of the levels of acid added thereto during practice of the method of the invention. Note that the ratio of dilution water to shower water is approximately 90/10, indicating that the major quantity of recirculating water is utilized in the repulping process, while only a minor portion is used in the shower process.

A modest precipitation of lignin in a pulp flow, in a flow region where the lignin concentration is low, causes the precipitated lignin to adhere to the cellulosic fibers and results in an output weight increase in the resultant pulp feed. Such precipitation is accomplished by adding sufficient acidifying material to a repulped mixture to cause a minor precipitation of the lignin. Importantly, the location of the acid addition is limited to a point in the washing stages where a relatively low concentration of lignin exists. It has been found that addition of sufficient acidifying chemicals to the repulped flow between later washing stages enables an incremental decrease in pH of the pulp mat by about 0.5 to about 2.0 pH points, and results in a 2–5% increase in output pulp weight. This is achieved without incurring detrimental effects on the washing or subsequent pulp processing stages that can result from excess lignin precipitation.

A preferred method for addition of the acidifying chemicals is via application of a carbon dioxide flow to the outlet from seal tank 48, which outlet is utilized as a dilution water feed for repulper 44. As above indicated, the lignin concentration in repulper 44 is about 0.2 to about 5 grams per liter. This lignin concentration facilitates efficient precipitation onto cellulose fibers. Similarly, partially acidifying the slurry precipitates a modest amount of lignin onto the cellulosic fibers. For example, an incremental pH reduction of about 0.5 to about 2.0 can provide effective lignin precipitation. Then, when the pulp flow is fed to final washer 16, the amount of lignin that is washed out of the pulp mat is accordingly reduced (due to the binding of the lignin/cellulose fibers).

It is to be noted that addition of the acidifying chemicals must occur at a point in the washing process where lignin concentration is relatively low, as otherwise the acidification results in an excessive precipitation of lignin. This is to be avoided. Further, the amount of acidification of the pulp flow is kept within a modest range so as again to prevent excessive lignin precipitation. While $CO_2$ is the preferred additive to achieve acidification of the pulp flow, other acids may be employed, e.g. $H_2SO_4$.

In order to measure the amounts of bound lignin in the outflow from pulp washer system 10, Kappa numbers of the output washed pulp were measured in laboratory tests. Tests were performed at the University of Vicosa, Brazil, where pulp samples were prepared to different Kappa numbers, i.e., 60, 80 and 95, that are typical for different grades of unbleached pulp. The pulp samples were acidified with carbon dioxide to different pH levels in the presence of diluted black liquor and the resulting Kappa number was measured. In each case, it was possible to increase the Kappa number of the treated sample to cause an increase in effective yield of from 2–5%. Next, various physical properties were measured and compared.

Figure 2:
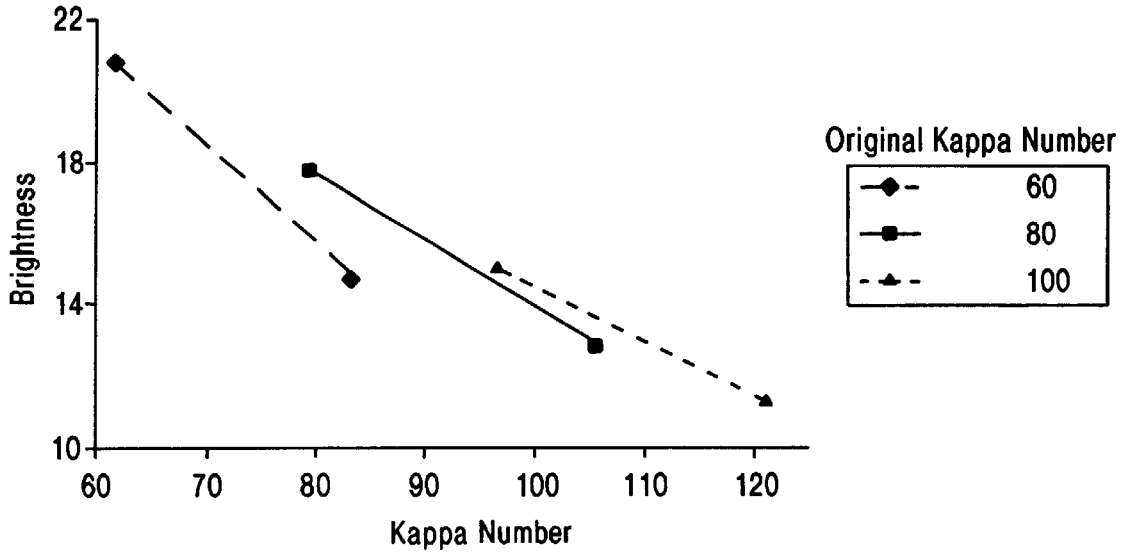
FIG. 2 illustrates the effect of increased Kappa number on brightness of the resulting product, for various starting Kappa numbers of the original pulp.
Figure 3:
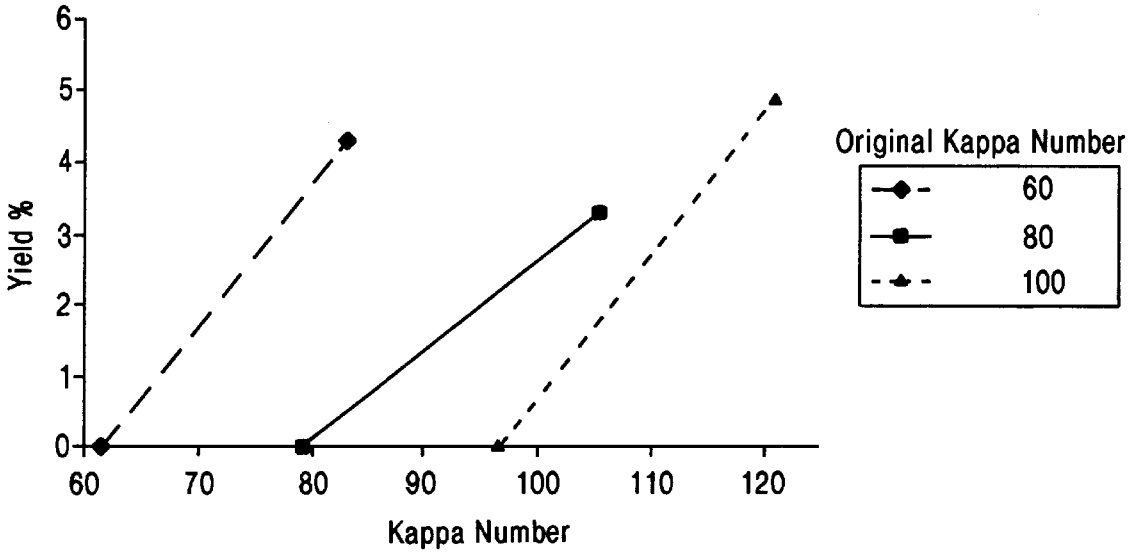
FIG. 3 is a plot of Kappa number versus yield for pulp samples having original Kappa numbers of 60, 80 and 100, respectively.
Figure 4:
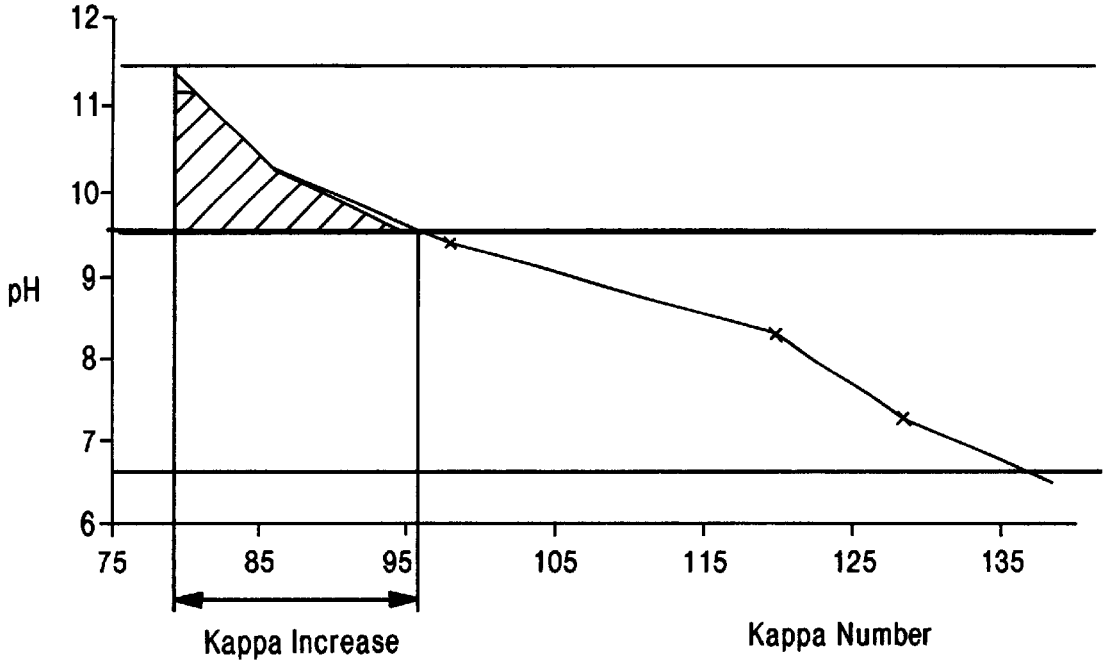
FIG. 4 illustrates the changes in Kappa number, which result vs. changes in pH of the product, when acidifying agent is added to the pulp stream in accord with the invention.

FIG. 2 illustrates the effect of increased Kappa number on brightness of the resulting product, for various starting Kappa numbers of the original pulp. FIG. 3 is a plot of Kappa numbers versus yield for pulp samples having original Kappa numbers of 60, 80 and 100, respectively. FIG. 4 illustrates the changes in Kappa number which result vs. changes in pH of the product, when acidifying agent is added to the pulp stream in accord with the invention.

Comparing pulps of equivalent ultimate Kappa numbers, it was seen that the pulps produced with the pulp yield enhancement (PYE) method of the invention generally had improved physical properties (see Table 2) over those produced by the traditional method.

TABLE 2

| | Equivalent Kappa Pulps Showing Improved Physical Properties for Pulps Produced in accord with the invention. | | | | | | |
|---|---|---|---|---|---|---|---|
| | Tensile Index N · m/g | Burst Index kPa · $m^2$/g | Tear Index mN · $m^2$/g | Stretch % | Tensile Energy Absorption J/$m^2$ | Stress at Property Limits MPa | Modulus of Elasticity MN · m/kg |
| Kappa 80 | 73 | 6.4 | 13.7 | 3.2 | 99 | 18.2 | 6.2 |
| PYE Kappa 80 | 77.1 | 6.6 | 13 | 3.1 | 103.6 | 20.1 | 6.8 |
| Kappa 95 | 75 | 6.4 | 12.3 | 3.4 | 108 | 18 | 6.1 |
| PYE Kappa 105 | 72.5 | 6.5 | 12.5 | 2.9 | 88 | 18.2 | 6.4 |
| Kappa 120 | 62.6 | 5.6 | 10.6 | 2.7 | 71.4 | 16.2 | 5.8 |
| PYE Kappa 120 | 73.9 | 6.5 | 11.4 | 2.9 | 88.3 | 18 | 6.5 |

Looking at pulps prepared to a same initial Kappa number and comparing them to yield-enhanced pulps, equivalent physical properties are seen (see Table 3).

TABLE 3

| | Pulps Produced at Various Kappa Numbers and Corresponding Yield Enhance Pulps Showing Equivalent Physical Properties | | | | | | |
|---|---|---|---|---|---|---|---|
| | Tensile Index N · m/g | Burst Index kPa · $m^2$/g | Tear Index mN · $m^2$/g | Stretch % | Tensile Energy Absorption J/$m^2$ | Stress at Property Limits MPa | Modulus of Elasticity MN · m/kg |
| Kappa 60 | 75.7 | 6.7 | 13.5 | 3.3 | 108 | 19 | 6.4 |
| PYE Kappa 80 | 77.1 | 6.6 | 13 | 3.1 | 103.6 | 20.1 | 6.8 |
| Kappa 80 | 73 | 6.4 | 13.7 | 3.2 | 99 | 18.2 | 6.2 |
| PYE Kappa 105 | 72.5 | 6.5 | 12.5 | 2.9 | 88 | 18.2 | 6.4 |
| Kappa 95 | 75 | 6.4 | 12.3 | 3.4 | 108 | 18 | 6.1 |
| PYE Kappa 120 | 73.9 | 6.5 | 11.4 | 2.9 | 88.3 | 18 | 6.5 |

Based on common industry knowledge, it was expected that the precipitation of lignin onto the pulp would result in less desirable physical properties. This is based in part on the theory that cellulose pulp fibers are electrochemically bound to each other, resulting in strong bonds. In contrast, the lignin/cellulose pulp bond is thought to be a mechanical bond, not unlike a wood/glue bond. Physical strength properties of the resultant yield-enhanced pulp produced an unexpected result. Measurements showed the lignin yield enhanced pulp as having effectively equivalent strength properties to the control pulp, which has not added lignin (same initial Kappa number).

Pulps produced at different Kappa numbers (i.e. the lower Kappa pulp had its Kappa number increased through lignin precipitation) showed improved physical properties for the yield-enhanced pulp.

In a summary, an acid such as $CO_2$, $SO_2$ or sulfuric acid is injected into a dilute lignin stream, such as dilution water, during the washing stage of brown stock pulp or into the fresh water make-up to the washing system. The pH of the dilute lignin stream is reduced to a level sufficient to cause the precipitation of lignin onto the pulp fiber and to increase the Kappa number by at least about 1 point. For purposes of this specification, the increase in Kappa number is measured in comparison to a test pulp taken from a pulp stream untreated with acid in the same washing location. A precipitation of sufficient lignin to increase Kappa number by 1 point provides a commercially significant improvement in pulp production. Advantageously, precipitating the lignin increases the Kappa number by about 2.5 to about 50 points and most advantageously by about 5 to about 30 points provides a dramatic increase in pulp yield. Additional acid may be added to the fresh water make-up stream in order to cause sufficient lignin precipitation. Initial mill tests indicated that an addition of 10 to 20 kilograms of carbon dioxide per ton of air-dried pulp achieves a 1.5% to 3% increase in yield. By addition of sufficient acid, the required amount of lignin is removed from solution and precipitated on the pulp to improve pulp yield in mill tests by between 3 to 4%, but not so much as to cause caking or blockages in piping or on the washer.

Although vacuum drum washers are preferred, the process of the present invention can be carried out on other types or washers, including, but not limited to, diffusion washers, pressure washers, presses, and belt washers. In fact, the process of the present invention may be employed on washing lines using any combination of washing equipment, for example, a diffusion washer followed by a single-stage vacuum drum washer. The process of the present invention is viable for both single- and multi-stage brown stock washers.

The process of the present invention is viable for all wood species, including, but not limited to hardwoods, softwoods and eucalyptus. Although wood is the preferred raw material, any raw material that may be pulped by the Kraft process will serve. Examples of non-wood materials that may benefit by the present invention are bagasse and sugarcane.

It should be understood that the foregoing description is only illustrative of the invention. Various alternatives and modifications can be devised by those skilled in the art without departing from the invention. Accordingly, the present invention is intended to embrace all such alternatives, modifications and variances that fall within the scope of the appended claims.

What is claimed is:

1. A method for processing alkaline cellulosic pulp to cause a precipitation of lignin onto pulp fibers, comprising the steps of:

(a) washing the pulp in a series of washer stages to sequentially remove entrained lignin therefrom;

(b) between each washer stage, adding dilution water to repulp a pulp mat exiting from a prior washer stage and to create a pulp stream for a next washer stage, said pulp stream containing said entrained lignin;

(c) after at least one of the washer stages, adding an acidifying agent to said pulp stream to form a pulp product by precipitating said entrained lignin onto cellulosic fibers contained in said pulp stream; and (d) removing said pulp product from said series of washer stages with said pulp product having at least about a 1 unit increase in Kappa number, said increase in Kappa number arising from said precipitating of said entrained lignin.

2. The method as recited in claim 1, wherein said acidifying agent is added to said pulp stream having a concentration of said entrained lignin in a range from about 0.2 to about 5 grams per liter.

3. The method as recited in claim 1, wherein a sufficient amount of said entrained lignin is precipitated in said pulp stream to increase Kappa number of said pulp product from about 2.5 to about 50 units.

4. The method as recited in claim 1, wherein said acidifying agent is carbon dioxide.

5. The method as recited in claim 4, wherein a sufficient amount of said entrained lignin is precipitated in said pulp stream to increase Kappa number of said pulp product from about 5 to about 30 units.

6. The method as recited in claim 4, wherein said acidifying agent is added to said pulp stream having a concentration of said entrained lignin in a range from about 0.5 to about 2 grams per liter.

7. The method as recited in claim 1, wherein said acidifying agent is added to a repulper between succeeding washing stages.

8. The method as recited in claim 1, wherein said adding of said acidifying agent precipitates said entrained lignin after at least two washing stages and increases Kappa number by at least about one after each of said at least two washing stages.

9. The method as recited in claim 1, wherein said method is carried out in a three washer system and said acidifying agent is added to a repulper between second and third washing stages.

* * * * *